US005855297A

United States Patent [19]

Tichenor et al.

[11] Patent Number: 5,855,297

[45] Date of Patent: Jan. 5, 1999

[54] WIRELESS-OPERATED ANTI-GRAFFITI SPRAY CAN SYSTEM

[76] Inventors: Clyde L. Tichenor, 905 N. Oak Ave., Fillmore, Calif. 93015; Steven J. Bierend, 530 Parkview North, Santa Maria, Calif. 93455

[21] Appl. No.: 841,197

[22] Filed: Apr. 29, 1997

[51] Int. Cl.[6] ..... B65B 5/00

[52] U.S. Cl. ..... 222/61; 222/153.11; 222/402.11; 222/504; 340/540

[58] Field of Search ..... 222/23, 52, 61, 222/63, 153.11, 153.14, 402.1, 402.11, 402.13, 504; 340/540, 541

[56] References Cited

U.S. PATENT DOCUMENTS

| | | | |
|---|---|---|---|
| 3,993,218 | 11/1976 | Reichenberger | 222/30 |
| 4,996,521 | 2/1991 | Hollow | 340/541 X |
| 5,255,819 | 10/1993 | Peckels | 222/30 X |
| 5,318,197 | 6/1994 | Martindale et al. | 222/504 X |
| 5,385,271 | 1/1995 | Bierend et al. | 222/402.11 X |
| 5,427,277 | 6/1995 | Bierend et al. | 222/504 X |
| 5,528,220 | 6/1996 | Woods | 340/540 X |
| 5,603,433 | 2/1997 | Rene | 222/153.11 |
| 5,675,318 | 10/1997 | Hunt, Jr. | 340/540 |
| 5,791,520 | 8/1998 | Tichenor | 222/504 X |

*Primary Examiner*—Kevin P. Shaver
*Attorney, Agent, or Firm*—Albert O. Cota

[57] ABSTRACT

A wireless-operated anti-graffiti spray can system (10) which allows a pressurized spray can (162) to be electronically operated from a remote location. The system (10) is disclosed in two designs: in the first design, a spray can activating device (38) consisting of a solenoid/valve assembly (42), which operates in combination with an electromagnetic coil (40), is used to control the spray can (162). In the second design, the activating device (38) consists of an electro-mechanical solenoid (138), which operates an articulated spray control leaf (142) that is used to the control the spray can (162). In both designs, a transmitting unit (12) is utilized that can only be enabled when connected to a utility a-c power source (160). The transmitting unit (12) produces an RF signal that is received by a receiving unit (28) located remotely and adjacent to the spray can activating device (38). The receiving unit produces a power signal which, in the first design, causes the activating device (38) to produce a magnetic field, thus causing the solenoid/valve assembly (42) to be energized; in the second design the power signal is applied directly to the solenoid (138) which causes the solenoid (138) to be energized. In both designs the spray can can only be used after, either the solenoid/valve assembly (42), or the solenoid (138) has been energized.

20 Claims, 2 Drawing Sheets

WIRELESS-OPERATED ANTI-GRAFFITI SPRAY CAN SYSTEM

TECHNICAL FIELD

The invention pertains to the general field of tamper-proof anti-graffiti spray cans and more particularly to a spray can that incorporates a receiving unit which is operated by a remote transmitting unit that can only be energized when connected to a utility a-c power source.

BACKGROUND ART

The act of marking any public or private surface with words, symbols and/or signs, without the owner(s) permission, is known as graffiti, or tagging. In previous years graffiti artists, or taggers, would primarily deface a specific location to signify a gang's territory or for revenge. During the last few years, however, taggers have been placing graffiti on virtually every surface possible. In fact, a status symbol among taggers is one's ability to mark a surface that is particularly dangerous to reach. In most major cities graffiti has unfortunately become a common sight for residents, businesses and visitors.

In order to attempt to control the onslaught of graffiti, city governments have implemented graffiti removal and watch programs. In recent years a city such as Los Angeles, Calif. spent over $10 million annually on these programs. In New York, the Transit Authority spent $6 billion in subway cleanup campaigns. These figures only represent one small part of the total cost resulting from graffiti. There are significant additional costs which stem from paying police and private security companies to apprehend taggers and, subsequent legal costs to prosecute and, if necessary, incarcerate the offenders.

Graffiti has also resulted in noticeable hardships for both the paint companies who manufacturer spray paint, and the average consumer, who must endure difficulties just to purchase the paint. Not only must all spray paint purchasers be 18-years-of-age or older (with valid I.D. ) but, also, the paint itself is kept in locked cabinets where only an employee of the paint store has access. What should be a simple, fairly quick retail paint purchase can become a time-consuming, offensive ordeal—especially if a person who happens to appear younger than 18 accidently forgets to bring his/her I.D. Some cities have even proposed a complete ban on the sale of all spray paint. It is unlikely this will occur but it does illustrate just how serious the graffiti problem has become.

If there was some way to provide spray paint that would be impossible or, at least significantly difficult for taggers to use, some of the graffiti problem could be eliminated.

DISCLOSURE OF THE INVENTION

The wireless-operated anti-graffiti spray can system disclosed herein is designed to allow a pressurized spray can, such as an aerosol spray can, to be operated without being hardwired to a utility a-c power source. In its most basic design configuration, the system is comprised of:

a) a transmitting unit having circuit means for producing an RF signal when the transmitting unit is connected to a utility a-c power source, b) a remote receiving unit having circuit means for receiving the RF signal from the transmitting unit and producing a power signal, and c) a spray can activating means that interfaces with a pressurized spray can in combination with the receiving unit. When the spray can activating means is applied the power signal from the receiving unit, the activating means allows the pressurized spray can to be used.

The basic system is further disclosed in two design configurations.

In the first design, the spray can activating means consists of a solenoid/valve assembly which is operated by an electromagnetic coil that is placed around the spray can in the vicinity of the solenoid/valve assembly. When the electromagnetic coil is applied the power signal from the remote receiving unit, the electromagnetic coil produces a magnetic field. This field then causes the solenoid/valve assembly to be energized and placed in a position which allows the pressurized spray can to be used.

In the second design, the spray can activating means consist of a solenoid controlled spray top. When the solenoid is not energized an articulated leaf, located in the top, is located in a first position which precludes the use of the pressurized spray can. conversely, when the solenoid is energized by the application of the power signal from the remote receiving unit, the articulated leaf is placed in a second position which allows the pressurized spray can to be used.

In view of the above disclosure, it is the primary object of the invention to produce a pressurized spray can that is not required to be directly hardwired to a utility a-c power source to allow its use. Further, it is also an object of the invention to allow the spray can to function by utilizing a transmitting unit that produces an RF signal that is received by a remote receiving unit attached to a spray can whereupon receiving the RF signal the spray can is energized and can be used to spray paint.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the wireless-operated anti-graffiti spray can system 10 is presented in terms of a preferred embodiment that is disclosed in two designs. In each design, the invention allows a pressurized spray can to be operated from a wireless, remote power source.

Figure 1:
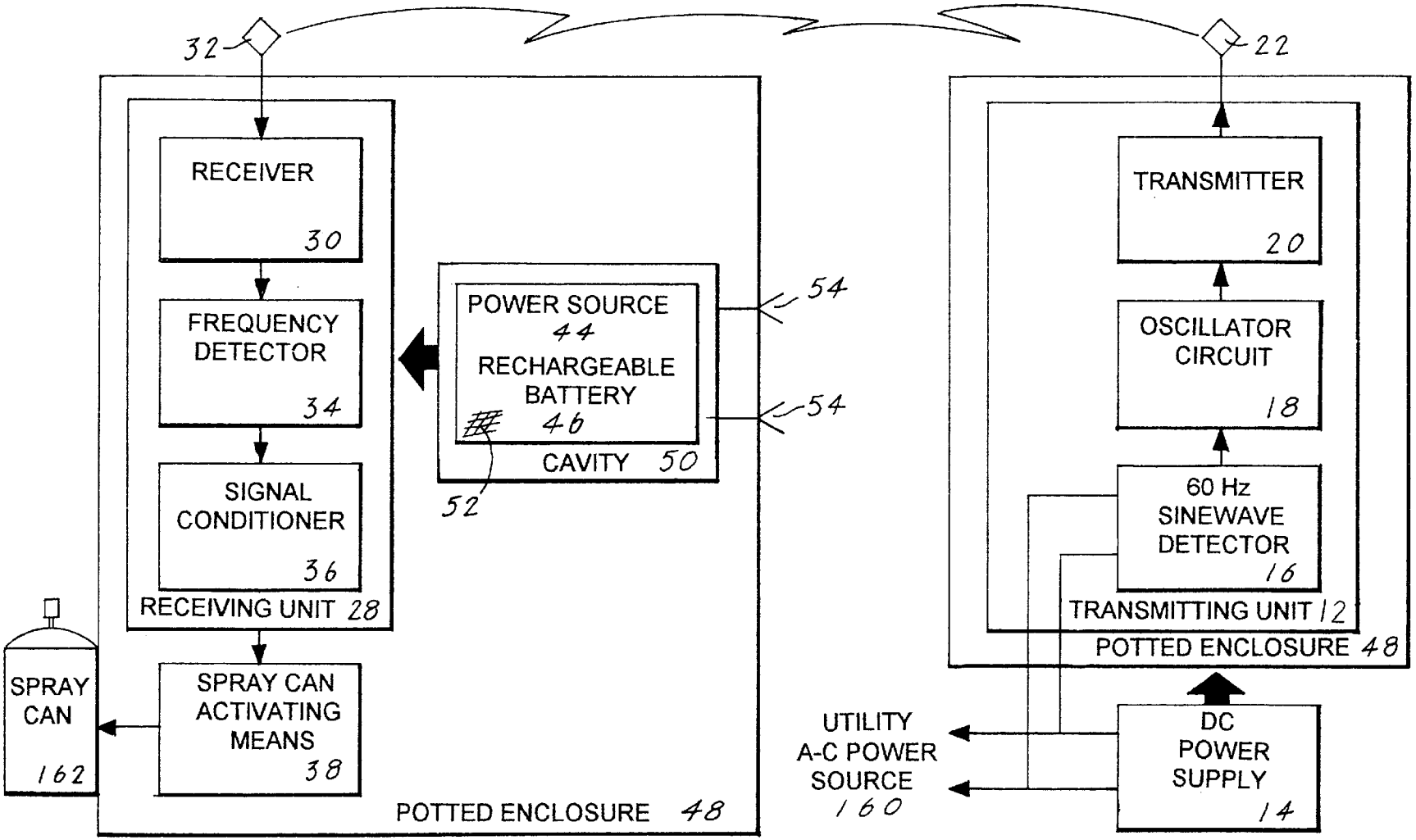
FIG. 1 is a block diagram of the wireless-operated anti-graffiti spray can.
Figure 2:
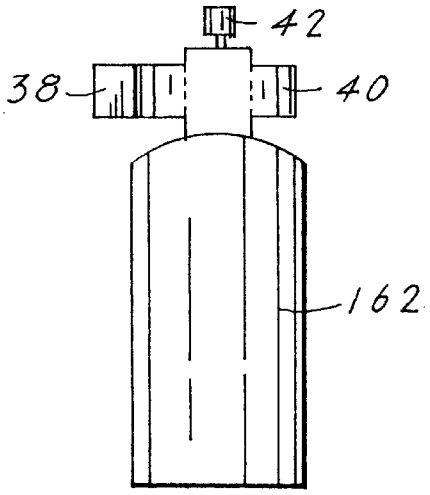
FIG. 2 is a pictorial diagram showing the relative locations of the spray can, the solenoid/valve assembly, the electromagnetic coil and the spray can activating means as utilized in the first design of the preferred embodiment.

The first design of the spray can 10, as shown in FIGS. 1 and 2, is comprised of the following three major elements: a transmitting unit 12, a remote receiving unit 30 and a spray can activating means 38. The transmitting unit 12 is further comprised of a d-c power supply 14, a 60 Hz sinewave detector 16, an oscillator circuit 18, a transmitter 20 and an antenna 22. The remote receiving unit 28 is further comprised of a receiver 30, an antenna 32, a frequency detector 34 and a signal conditioner 36. The spray can activating means 38 of the first design operates a solenoid valve assembly 42 that is described in detail in the applicant's U.S. Pat. No. 5,427,277 which is hereby incorporated by reference.

The transmitting unit 12 is powered by the d-c power supply 14 as shown in FIG. 1. This power supply is designed to provide the required power levels to operate the transmitting unit 12. Additionally, the power supply is further designed to be operated only when it is connected to a utility a-c power source 160.

As shown in FIG. 1, the utility a-c power source 160 is simultaneously applied to the a-c power supply 14 and to the 60 Hz sinewave detector 16. The detector 16 is designed to produce an oscillator-enabling signal only when the applied a-c power signal is specifically derived from the utility a-c power source 160.

The oscillator circuit includes circuit means for receiving the oscillator 18 enabling signal from the detector 16 and producing an output signal. The oscillator also has circuit means for selecting a plurality of preset frequency signals that may or may not be coded. Thus, the output of the oscillator corresponds to at least one of the pre-set frequency signals.

The output signal from the oscillator circuit 18 is applied to the transmitter 20 which has circuit means for being enabled by at least one of the output signals. The transmitter 20 is designed to produce an RF signal that is transmitted through the ether via the antenna 22.

The transmitted REF signal is received by the receiving unit 28 as also shown in FIG. 1. The RF signal is applied via the antenna 32 to the receiver 30 which produces an output signal.

The frequency detector 34 has means for receiving the output signal from the receiver 30 and producing a corresponding detected signal which is subsequently applied to a signal conditioner 36 having circuit means for producing a power signal.

The power signal is applied to a spray can activating means 38 that is placed in association with a pressurized spray can 162. The can 162 incorporates a solenoid/valve assembly 42. In the first design, as shown in FIG. 2, the activating means consists of an electromagnetic coil 40 having a center opening that is dimensioned to be inserted into and positioned around the spray can 162 in the vicinity of the solenoid/valve assembly 42. When the electromagnetic coil 40 is applied the power signal from the signal conditioner 36, the coil 40 produces a magnetic field. This magnetic field causes the solenoid/valve assembly to be energized and placed in a position which allows the pressurized spray can 162 to spray paint.

The final element described for the first design is the power source which is designed to provide the required power level to operate the receiving unit 28. Preferably, the power source consists of a rechargeable battery 46. Additionally, to prevent the transmitting unit 12 and the receiving unit 28 from being tampered with, they may be encapsulated in a hard potted enclosure 48 as shown in FIG. 1. The potted enclosure 46 for the receiving unit 28 may include a cavity 50 which is dimensioned to receive the rechargeable battery 46. The cavity is designed to accept a removable cover 52 which secures the battery 46 in place. Along side the enclosure 48 are located a pair of charging jacks that allow the battery to be charged when necessary.

Figure 3:
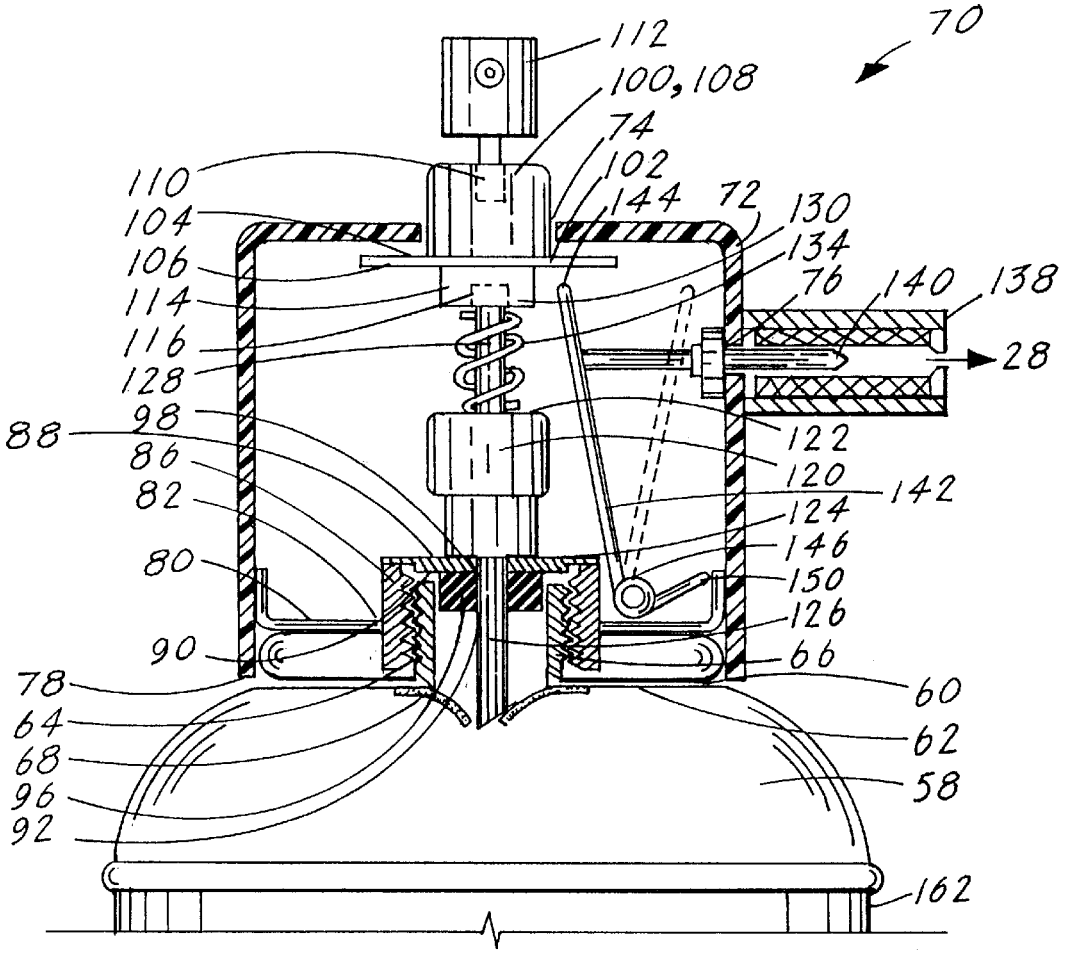
FIG. 3 is an elevational-sectional view of the second design of the preferred embodiment.

The second design of the wireless-operated anti-graffiti spray can system 10, as shown in FIG. 3, functions with a spray control means that utilizes a solenoid-controlled paint spraying assembly 70. When the electro-mechanical solenoid is energized the assembly 70 is placed in a first position which precludes the use of the pressurized spray can 162 and conversely, when the assembly 70 is energized, by the application of the power signal from the signal conditioner, the assembly 70 is placed in a second position which allows the pressurized spray can to be used.

The spray control means, as shown in FIG. 2, is comprised of the following major elements: a spray can upper cover 58, a puncturable seal 66, a threaded sleeve 68, a solenoid-controlled paint spraying assembly 70, a non-metallic housing 72, a threaded cap 86, a sprayhead housing 100, a spring valve 120, an electro-mechanical solenoid 138 and a spray control leaf 142.

In the second design, the spray can 162 must be modified, as shown in FIG. 3, by having a spray can upper cover 58 that has an upper surface 60 and a lower surface 62. Substantially centered on the cover 58 is a sleeve bore 64. Extending upward from the edges of the sleeve bore 64 and attached thereto, by an attachment means, is a threaded sleeve 66. The final modification consists of adding a puncturable seal 68 that extends across the sleeve bore 64 on the lower surface 62 of the cover 58 and that is attached thereto by an attachment means.

The primary inventive element of the second design is the solenoid-controlled paint spraying assembly 70, as also shown in FIG. 3. The assembly 70 is enclosed without a non-metallic housing 72 that is preferably formed of a ceramic material. The housing has an upper cap opening 74, a keyed side opening 76 and lower edges 78 that interface with the upper surface 60 of the spray can upper cover 58. Attached above the lower edges 78 is a platform 80 that includes a central cap opening 82. Attached to the opening 82, by an attachment means, is a threaded cap 86. The cap is dimensioned to be threaded into the threaded sleeve 66 and has an upper surface 88, a lower surface 90, and a first tube bore 92 therethrough. Pressing against the lower surface 90 of the threaded cap 86 is a resilient seal 96. This seal includes a second tube bore 98 that when the seal is installed, it is in alignment with the first tube bore 92 on the threaded cap 86.

The upper most element of the second design is the sprayhead housing 100 which is preferably formed from a ceramic material. This housing has a substantially centered retaining skirt 102 that includes an upper surface 104 and a lower surface 106. From the upper surface 104 of the skirt 102 extends an upper section 108. This section 108 has a sprayhead stem bore 110 into which is inserted a standard spray head 112 as shown in FIG. 3. From the lower surface 106 of the skirt 102 extends a spring retaining section 114 that has a third tube bore 116 that intersects with the sprayhead stem bore 110.

Between the threaded cap 86 and the sprayhead housing 100 is the spring valve 120 which includes an upper surface 122 and a lower surface 124. From the lower surface 124 extends downward a piercing paint tube 126 that is dimensioned to slidably traverse the first and second tube bores 92,98 and has a length that extends beyond the plane of the puncturable seal 68. The seal is punchured when the threaded cap 86 is screwed on to the threaded sleeve 66 at which time paint will flow upward through the piercing paint tube 126.

From the upper surface 122 of the spring valve 120 extends a paint tube 128 having an upper end 130 that fits into the third tube bore 116 located in the spring retaining section 114 of the sprayhead housing 100. The paint tube 128 is formed of a frangible material and has a larger inside diameter than the diameter of the sprayhead stem. This larger diameter prevents the use of a standard sprayhead 112 in the event a tagger decides to break the housing 72. Also, because the paint tube 128 is formed of a frangible material it is likely that it will be broken when the housing is ruptured, thus preventing a smooth paint flow and directed spray.

Around the paint tube 128 is inserted a spring 134 that is located between the spring retaining section 114 and the upper surface 122 of the spring valve 120. The spring maintains the sprayhead housing 100 biased in an upward direction with the skirt 102 pressed against the non-metallic housing 72. The electro-mechanical solenoid 138 is attached, by an attachment means, to the keyed side opening 76 located on the housing 72. When the solenoid is attached, the solenoid armature 140 extends inward through the keyed side opening 76.

The final element described for the second embodiment is the spray control leaf 142. The leaf has an upper end 144, a lower end 146 and an outer side 148 that is attached, by an attachment means, to the armature 140 of the solenoid 138. The lower end 146 of the leaf 142 is articulated and the upper end 144 is maintained in either a first position or a second position. The first position is maintained by a spring 150 that places the leaf's upper end 144 near the lower surface 106 of the skirt 102. When the leaf is in the first positions the sprayhead 112 cannot be depressed to allow the use of the spray can. When the solenoid 138 is energized by the power signal from the receiving unit 28, the leaf 142 is retracted by the solenoid 138 and placed in the second position which then allows the sprayhead 112 to be depressed and allow the spray can to be used.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

We claim:

1. A wireless-operated anti-graffiti spray can system comprising:

a) a transmitting unit having circuit means for producing an RF signal when said transmitting unit is connected to a utility a-c power source, b) a remote receiving unit having circuit means for receiving said RF signal from said transmitting unit and producing a power signal, and c) a spray can activating means that interfaces with a pressurized spray can in combination with said receiving unit, wherein when said spray can activating means is applied the power signal from said receiving unit, said activating means allows the pressurized spray can to be used.

2. The system as specified in claim 1 wherein said spray can activating means comprises a solenoid/valve assembly which is operated by an electromagnetic coil placed around said spray can in the vicinity of said solenoid/valve assembly, wherein when said electromagnetic coil is applied the power signal from said receiving unit, said coil produces a magnetic field which causes said solenoid/valve assembly to be energized and placed in a position which allows said pressurized spray can to be used.

3. The system as specified in claim 1 wherein said spray can activating means comprises a solenoid controlled spray top, wherein when said solenoid is not energized an articulated leaf, located on said top, is located in a first position which precludes the use of said pressurized spray can from being used and conversely, when said solenoid is energized by the application of the power signal from said receiving unit, said articulated leaf is placed in a second position which allows said pressurized spray can to be used.

4. A wireless-operated anti-graffiti spray can system comprising:

a) a transmitting unit comprising:

(1) a d-c power supply that is operated by an a-c power signal provided by a a utility a-c power source, wherein said power supply is designed to provide the required power levels to operate said transmitting unit, (2) a 60 Hz sinewave detector having means for receiving the a-c power signal from said utility a-c power source and producing an oscillator enabling signal when the applied a-c power signal is derived from the utility a-c power source, (3) an oscillator circuit having means for receiving the oscillator enabling signal from said detector and producing an output signal corresponding to at least one pre-set frequency, (4) a transmitter having means for being enabled by at least one of the output signals from said oscillator circuit and producing an RF signal that is transmitted via an antenna, b) a remote receiving unit comprising:

(1) a receiver having means for receiving via an antenna, the RF signal from said transmitter and producing at least one output signal, (2) a frequency detector having means for receiving the output signal from said receiver and producing a detected signal, (3) a signal conditioner having means for receiving the detected signal from said frequency detector and producing a conditioned power signal, (4) a power source designed to provide the required power levels to operate said receiving unit, and c) a spray-can activating means that interfaces with a pressurized spray can which incorporates a solenoid/valve assembly, wherein when said means is applied the power signal from said signal conditioner, said means produces a magnetic field which causes said solenoid/valve assembly to be energized and placed in a position which allows the pressurized spray can to be used to spray paint.

5. The system as specified in claim 4 wherein said 60 Hz sinewave detector, said oscillator circuit and said transmitter are encapsulated into a hard potted enclosure.

6. The system as specified in claim 4 wherein said spray-can activating means is comprised of an electromagnetic coil having a center opening that is dimensioned to be inserted into and positioned around said pressurized spray can in the vicinity of said solenoid/valve assembly.

7. The system as specified in claim 6 wherein said coil, said frequency detector and said receiver are encapsulated in a hard potted enclosure.

8. The system as specified in claim 7 wherein said enclosure having a cavity and removable cover into which said power source can be inserted and removed.

9. The system as specified in claim 8 wherein said power source comprises a rechargeable battery.

10. The system as specified in claim 4 wherein said oscillator circuit having further circuit means to produce coded output signals.

11. A wireless-operated anti-graffiti spray can system comprising.

a) a transmitting unit comprising:

(1) a d-c power supply that is operated by an a-c power signal provided by a a utility a-c power source, wherein said power supply is designed to provide the required power levels to operate said transmitting unit, (2) a 60 Hz sinewave detector having means for receiving the a-c power signal from said utility a-c power source and producing an oscillator enabling signal when the applied a-c power signal is derived from the utility a-c power source, (3) an oscillator circuit having means for receiving the oscillator enabling signal from said detector and producing an output signal corresponding to at least one pre-set frequency, (4) a transmitter having means for being enabled by at least one of the output signals from said oscillator circuit and producing an RF signal that is transmitted via an antenna, b) a remote receiving unit comprising:

(1) a receiver having means for receiving via an antenna, the RF signal from said transmitter and producing at least one output signal, (2) a frequency detector having means for receiving at least one output signal from said receiver and producing a detected signal, (3) a signal conditioner having means for receiving the detected signal from said frequency detector and producing a conditioned power signal, (4) a power source designed to provide the required power levels to operate said receiving unit, and c) a spray-can activating means that interfaces with a pressurized spray can, which incorporates a spray control means that functions in a first position and a second position, wherein the first position precludes the use of said pressurized spray can and conversely, when the power signal from said signal conditioner is applied to said spray control means the second position is activated which allows for use of said pressurized spray can.

12. The system as specified in claim 11 wherein said 60 Hz sinewave detector, said oscillator circuit and said transmitter are encapsulated in a hard potted enclosure.

13. The system as specified in claim 11 wherein said coil, said frequency detector and said receiver are encapsulated in a hard potted enclosure.

14. The system as specified in claim 13 wherein said enclosure having a cavity and removable cover into which said power source can be inserted and removed.

15. The system as specified in claim 14 wherein said power source comprises a rechargeable battery.

16. The system as specified in claim 11 wherein said oscillator circuit having further circuit means to produce coded output signals.

17. The system as specified in claim 11 wherein said spray control means comprises:

a) a spray can upper cover having:

(1) an upper surface, a lower surface and a sleeve bore, (2) a threaded sleeve extending upward from the edges of said sleeve bore and attached thereto by an attachment means, (3) a puncturable seal extending across said sleeve bore on the lower surface of said cover and attached thereto by an attachment means, b) a solenoid-controlled paint spraying assembly comprising:

(1) a non-metallic housing having an upper cap opening, a keyed side opening, lower edges that interface with the upper surface of said spray can upper cover and a platform attached above the lower edges and having a central cap opening, (2) a threaded cap attached, by an attachment means, to said central cap opening and dimensioned to be threaded into said threaded sleeve, with said cap having an upper surface, a lower surface and a first tube bore therethrough, (3) a resilient seal having a second tube bore that is in alignment with said first tube bore and wherein said seal presses against the lower surface of said threaded cap, (4) a sprayhead housing having a substantially centered retaining skirt having an upper surface and a lower surface, from where the upper surface of the skirt extends an upper section having a sprayhead stem bore into which is inserted a standard sprayhead and wherein from the lower surface of the skirt extends a spring retaining section having a third tube bore that intersects with the sprayhead stem bore, (5) a spring valve having an upper surface and a lower surface, wherein from the lower surface extends a piercing paint tube that is dimensioned to slidably traverse the first and second tube bores and having a length that extends beyond the plane of said puncturable seal, and wherein from the upper surface extends a paint tube having an upper end that fits into the third tube bore in the spring retaining section of said sprayhead housing, (6) a spring inserted around said paint tube between the spring retaining section and the upper surface of said spring valve, wherein said spring maintains said sprayhead housing biased in an upward direction with said skirt pressed against said non-metallic housing, (7) an electro-mechanical solenoid attached, by an attachment means, to the keyed side opening on said non-metallic housing, wherein when attached, the solenoid armature extends inward through the keyed side opening, and (8) a spray control leaf having an upper end, a lower end and an outer side that is attached, by an attachment means, to the armature of said solenoid, wherein the lower end of said leaf, is articulated and the upper end is maintained in either a first position or a second position, where the first position is maintained by a spring, that places the upper end of said leaf near the lower surface of said retaining skirt, wherein in the first position the sprayhead cannot be depressed to allow the use of the spray can, and wherein when said solenoid is energized by the power signal from said receiving unit, said leaf is retracted by said solenoid and placed in the second position which then allows said sprayhead to be depressed to allow said spray can to be used.

18. The system as specified in claim 11 wherein said non-metallic housing and said sprayhead housing are formed of a ceramic material.

19. The system as specified in claim 11 further comprising a centering washer having a central bore and located on the upper surface of said threaded cap.

20. The system as specified in claim 11 wherein said paint tube extending from the upper surface of said spring valve has a larger inside diameter than the diameter of the sprayhead stem and is formed from a frangible material.

* * * * *